United States Patent [19]

Lundh

[11] 4,114,381

[45] Sep. 19, 1978

[54] POSITIVE FLOW ESTUARY STRUCTURE

[75] Inventor: Roy W. Lundh, Glendora, Calif.

[73] Assignee: Poseidon Marketing and Development Co., Arcadia, Calif.

[21] Appl. No.: 779,174

[22] Filed: Mar. 18, 1977

[51] Int. Cl.[2] ..... E02B 7/20; E02B 7/44

[52] U.S. Cl. ..... 405/94; 405/101

[58] Field of Search ..... 61/1 R, 20, 29, 25, 61/64

[56] References Cited

U.S. PATENT DOCUMENTS

| | | | |
|---|---|---|---|
| 3,122,889 | 3/1964 | Bonamy | 61/20 |
| 3,138,932 | 6/1964 | Kofahl | 61/87 |
| 3,665,714 | 5/1972 | Bunger | 61/29 |

FOREIGN PATENT DOCUMENTS

| | | | |
|---|---|---|---|
| 18,238 of | 1913 | United Kingdom | 61/25 |

*Primary Examiner*—Jacob Shapiro

[57] ABSTRACT

A barrier device comprising a plurality of gated structures extending between opposite shores of a tidal estuary provides a means of preventing intrusion of heavier, colder sea water with each incoming tide and to then be the means for ejecting large volumes of collected sea water together with mud, sand and sewage pollutants. The eventual effect will be to create a body of fresh water of previously unattainable purity. This purity is renewable with the discharge of any excess water available. During periods of heavy withdrawal from the upstream pool all gates can be locked closed. After danger of flooding has ended the upstream pool can then store a very large volume of fresh water. Flood water is ejected as fast as it flows into the pool. Tidal power can be used to force flood water into the sea.

3 Claims, 8 Drawing Figures

POSITIVE FLOW ESTUARY STRUCTURE

BACKGROUND

There is no prior use of the art. A existing solution for water transfer can be eliminated since there is no need for it. This solution involves pumping, siphoning canal flows under four river outlets and the withdrawal of an enormous amount of prime agricultural land for rights of way. The deeply buried siphons are subject to closure by heavy siltation in the river system during periods of flooding. The canal system will invite intrusion of sea water since during periods of heavy withdrawal and low river flow a very strong reverse flow will suck sea water at the very bottom of the river system into the canal. Once the canal is poisoned there is no way to remedy the condition. The barrier will blunt the effect of a tsunami or a tidal bore created by earthquake. A gigantic wave with relentless fury strikes any shore of a tidal estuary.

A DETAILED DESCRIPTION OF THE DRAWINGS

Figure 1:
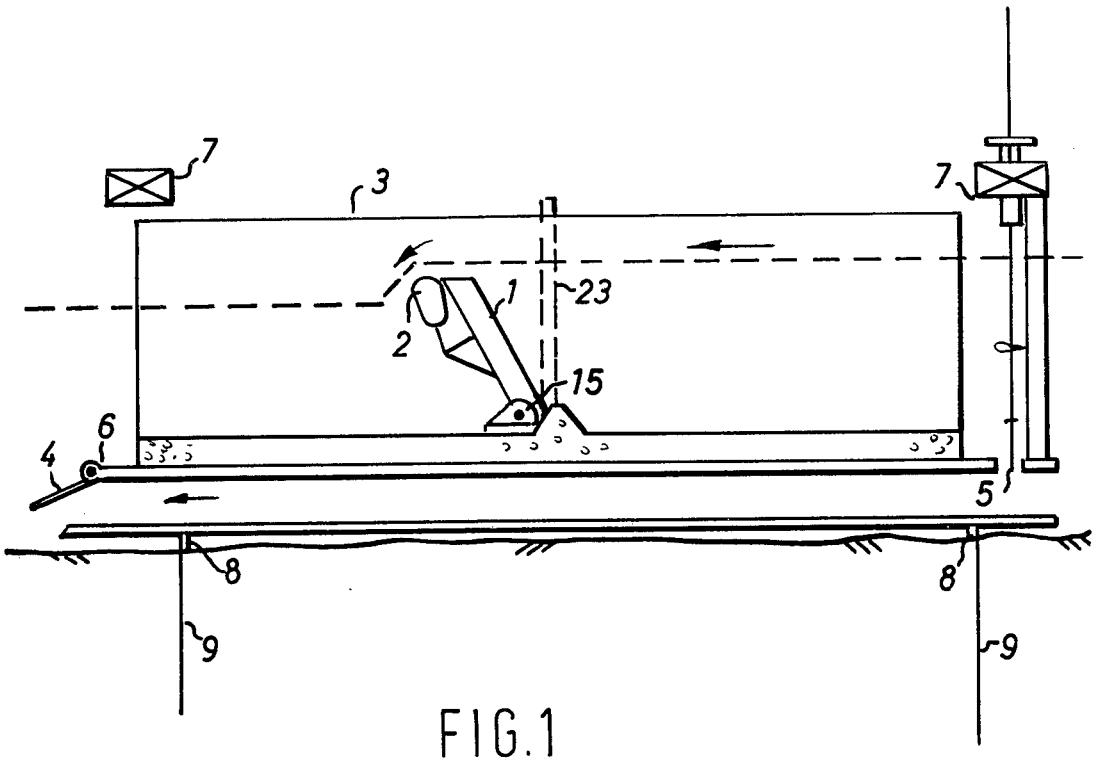
FIG. 1 is a cross sectional view of a culvert with gates at both ends topped by a bottom hinged flood gate wherein the water level upstream of the gate is higher than the downstream level and the gates are both open.

FIG. 1 shows a top hinged gate 4 pinned to culvert 6. The culvert ends rest on a level grade supported at each end by a sheet piling cut off wall 9 and locked to the piling by angle iron 8. The flood gate structure 3 is bottom hinged and the drawing shows the gate in the open position with flood water pouring over the top of the gate which has opened automatically due to the receding tide on the downstream side of the gate. A pair of truss beams 7 have several functions. Primarily they serve to give a precise alignment to pairs of adjacent piers allowing the gate structure to fit snugly against the pier leg. Leakage is tolerated since it is slight in any event. The beams also serve to give alignment and a level gauge for placement of piling. The upstream beam is shown as a base for the worm drive gate valve 5 which is used to seal the culvert in times of drought.

Figure 2:
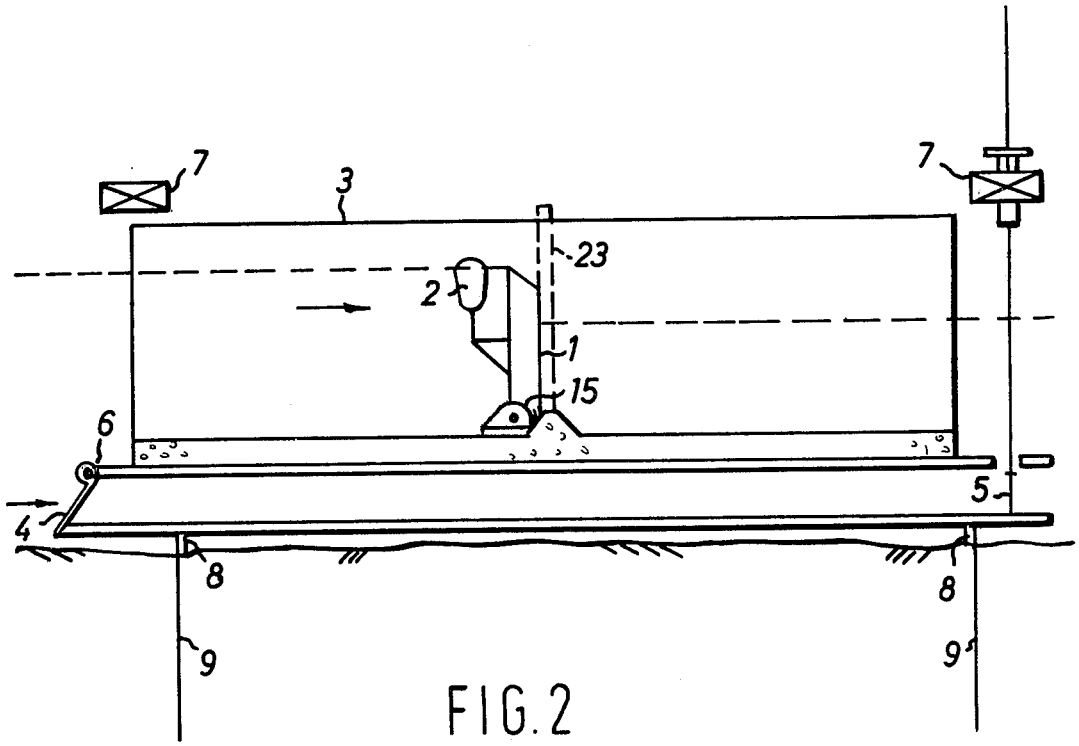
FIG. 2 shows all gates in a closed position, the water condition being a reverse of FIG. 1.
Figure 3:
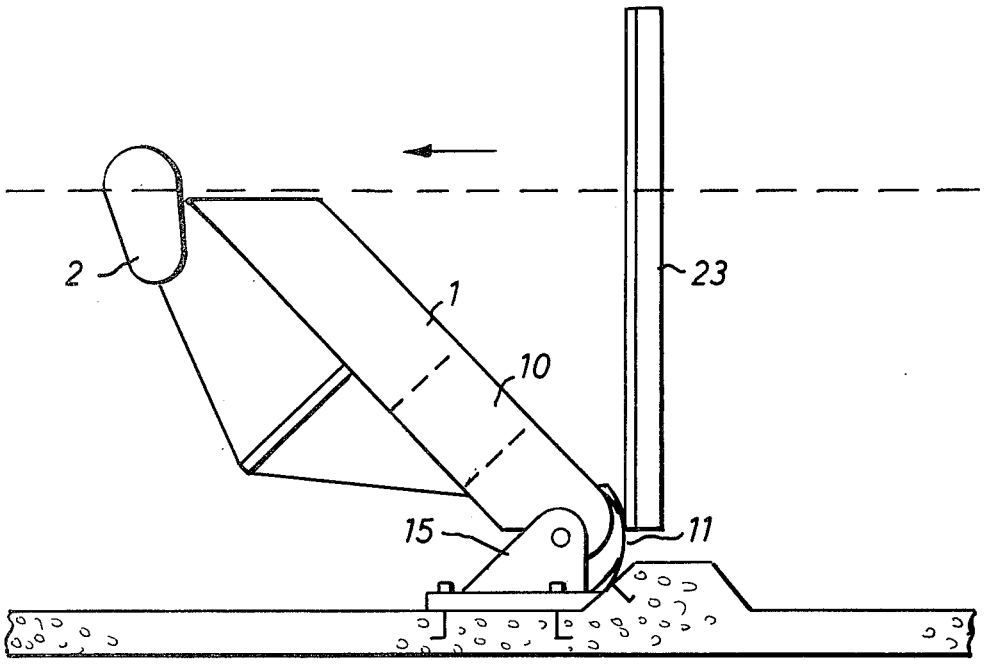
FIG. 3 is a detail of the flood gate and vertical stop.
Figure 4:
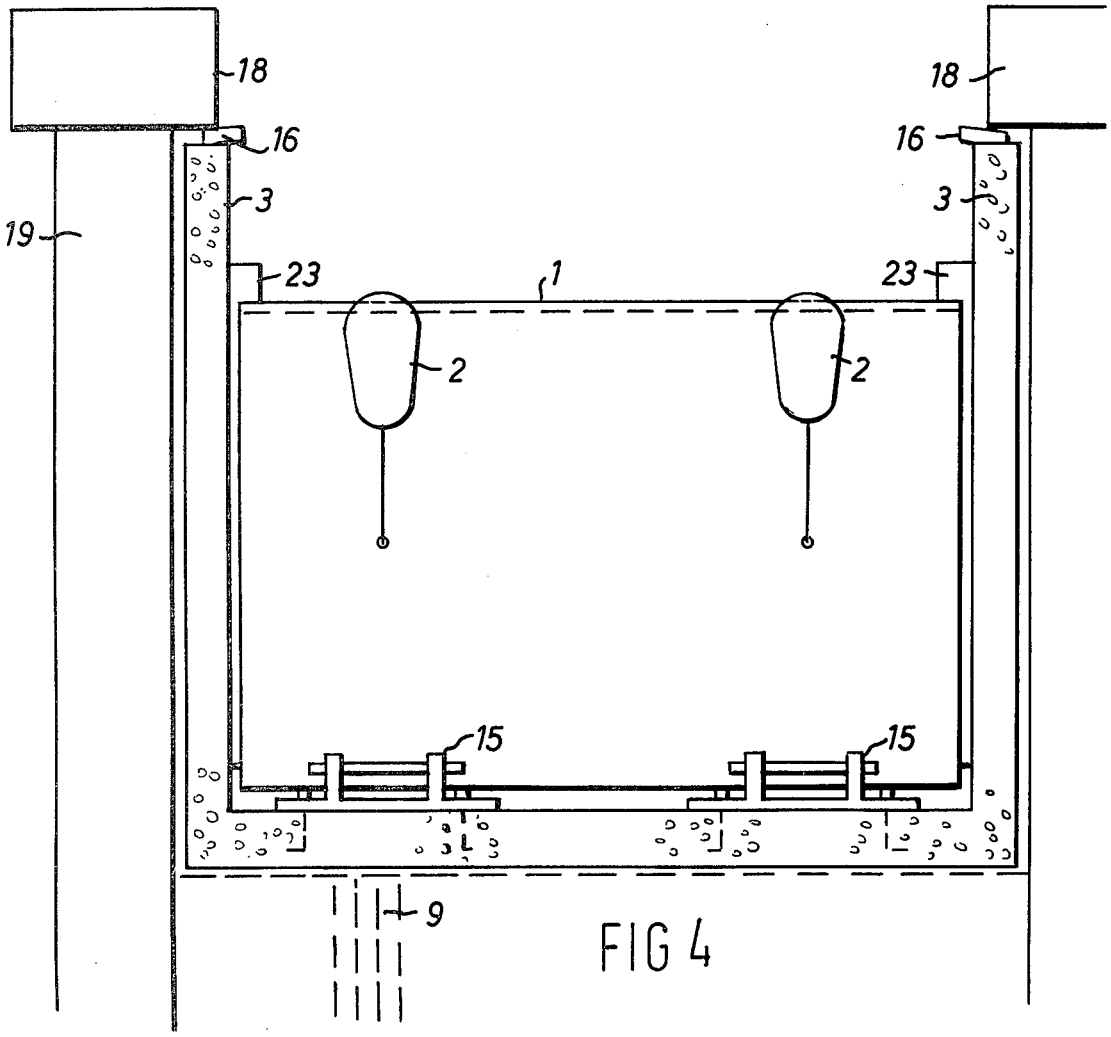
FIG. 4 is an end view of flood gate closed. No culvert is shown. Culverts are restricted to the deeper part of the river channel. The view is of the shallower part of the river channel

FIG. 2 shows the reverse flow of an incoming tide causing the buoy 2 to raise the lip of the gate above the water enough to allow the reverse flow to bite onto the gate and slam it vertically closed against stop 23. The upstream water level is not affected by the reverse flow and can rise only with the more or less rapid flow of downstream flood water. Without the barrier this flow is upstream. With the barrier there is a persistent downstream flow at all times caused by filling the upstream pool to at least the high tide mark. A more rapid flow takes place when the gates are overtopped in times of severe flooding. In time of drought the gates can become extended in height by ten feet causing several million acre feet of storage capacity in the Sacramento Delta channel system for beneficial use. FIG. 3 is a detailed cross section of a flood gate 1. A pressurized air tank 10 located just above the hinge not only induces a slight positive buoyancy, but acts to brace the gate horizontally, giving the effect of a beam. The said buoyancy reduces friction loss and allows the gate to become more sensitive to opening and closing forces acting on the gate. A flexible spring flap 11 halts bottom leakage. A plurality of non-corroding pin type hinges 15 are used. The catilevered buoy 2 flips the lip of the gate above the water surface to give "bite". FIG. 4 is a cross sectional schematic drawing of a flood gate structure 3 inserted between pier legs 19 and locked into place by wedge 16 pressing against the pier head 18. The method of making the insertion is described with FIG. 7. The gate rests on steel sheet piling 9.

Figure 5:
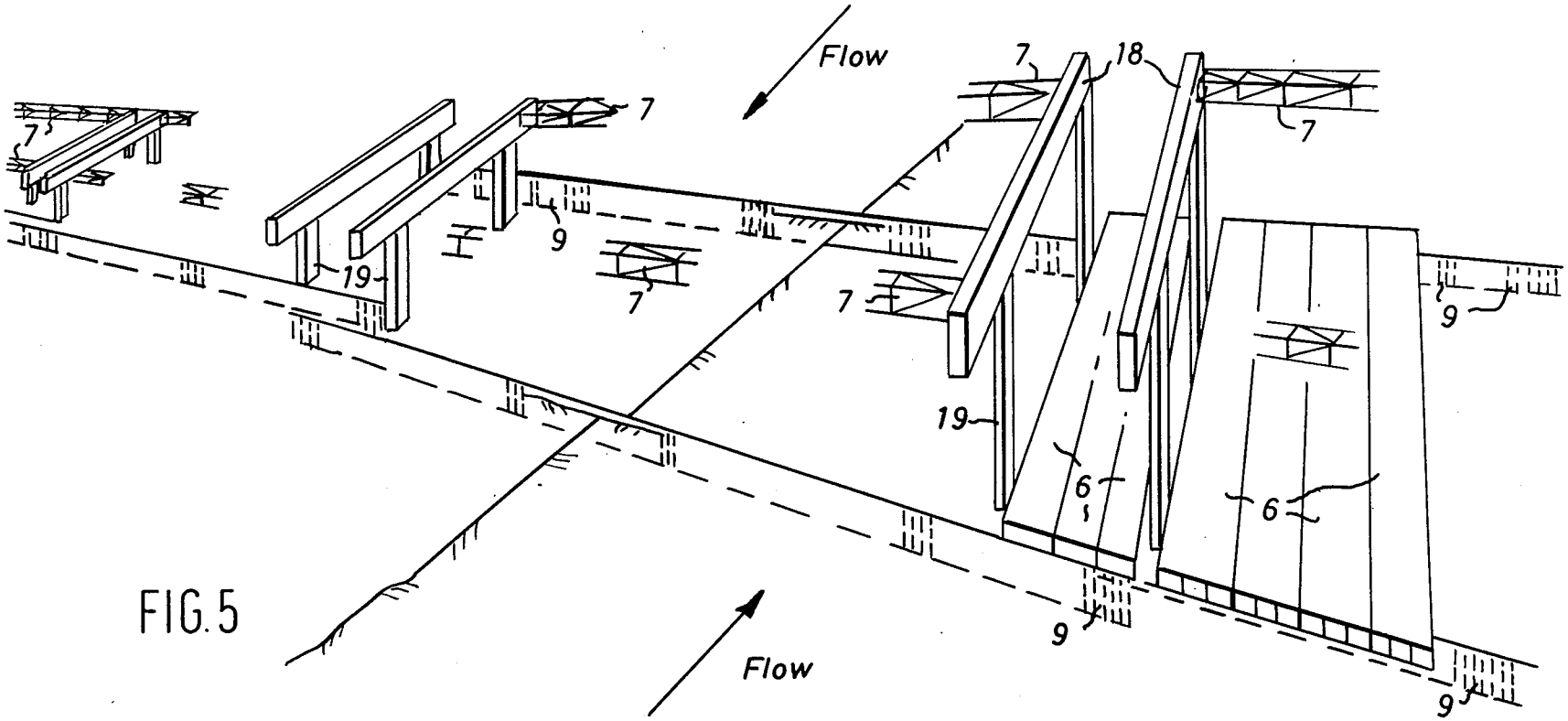
FIG. 5 is a schematic and perspective depiction of the foundation with culverts restricted to the deeper portion. Dewatering is not necessary for installation of the completed structure.

FIG. 5 is a schematic, partially perspective, partially elevational view of piers 18 with pairs of permanently attached truss beams 7. Steel sheet piling 9 is driven to a desirable depth into the soft bottom using the beam 7 for alignment and level grade. The pair of sheet piling walls not only serve as a level foundation for box culverts 6, or in most cases as foundations for gate structures 3, but also prevent scour under the supported structure. The walls overlap at the narrower openings to alloW for a change of profile grade as the gate placement proceeds from the deepest to the shallowest flood gate. A stair step progression can be made in either one or two stages. The overlapping prevents scour of the soft bottom soils always found in a tidal estuary. The truss beams 7 give precise spacing pairs of piers. Booms (not shown) can also give alignment as each new set of piers is floated into position as, shown in FIG. 8. The booms across the narrow portions are removed and give free passage for navigation locks floated into position. Other uses for the narrow slots is for passage of small craft and for fish passageway. A leakage here is of no great consequence compared to the leakage without a barrier. The truss beams also serve as walkaways for access to the manually controlled worm drive gate valves 5. Box culverts 6 are shown in place.

Figure 6:
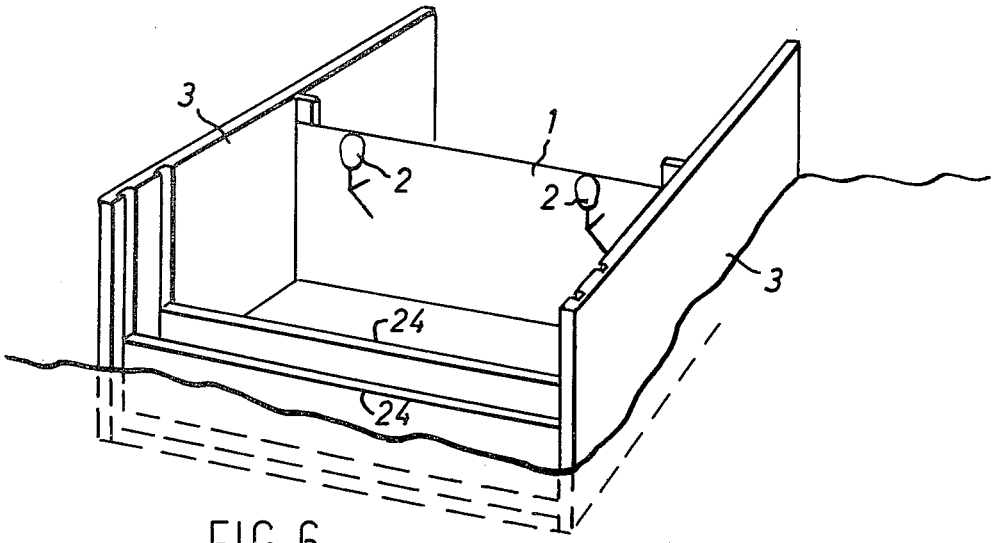
FIG. 6 shows a prefabricated flood gate made buoyant and floated to site.

FIG. 6 shows a flood gate structure 3 being floated into position. The gate structure may be made buoyant by various means. One of these is illustrated.

Figure 7:
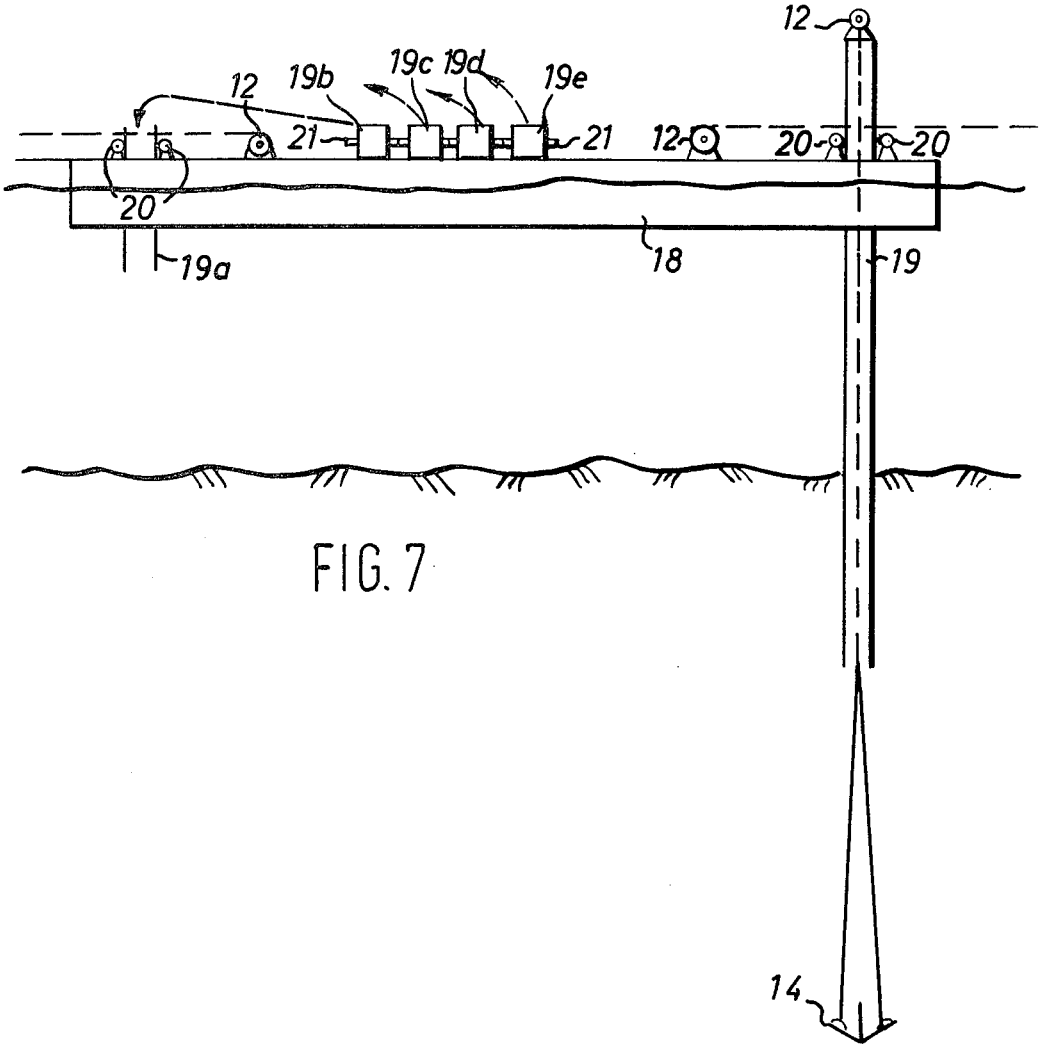
FIG. 7 shows one method of squeezing long hollow rectangular forms to a desired depth in the sea floor. A winch is seized to a deeply buried anchor.

FIG. 7 shows the method used to insert a pier into the watery environment without having to dewater the foundation. With the pier heads 18 in position and seized to anchors (not shown) by winches 12, short segments of pier legs 19*a*, 19*b* 19*c*, 19*d* and 19*e* progressively inserted into square openings 1 in the pier head and progressively welded together as they are lowered by rack or flat gear 21 and powered pinion gear 20 and then jacked a short distance into the mud bottom. An anchor placement vehicle (not shown) is inserted into the hollow leg. A projectile is fired 50 feet or so into the mud. The tether cable is seized to a winch 12 astride the top of the leg. The leg is squeezed downward and the bottom filled with concrete. The means for providing clearance for insertion of the gate structure beneath the truss beam becomes apparent in FIG. 7. A temporary extension to all four legs is inserted. The rack and pinion gears jack the pier heads 18 and the truss beams clear. The flood gate structure is inserted. The pier heads and trusses are jacked back down and a wedge 16 locks the gate structure to the mud sill. In the event of serious damage by ramming of a flood gate it is easy to see that a damaged section can be replaced rather than repaired.

Figure 8:
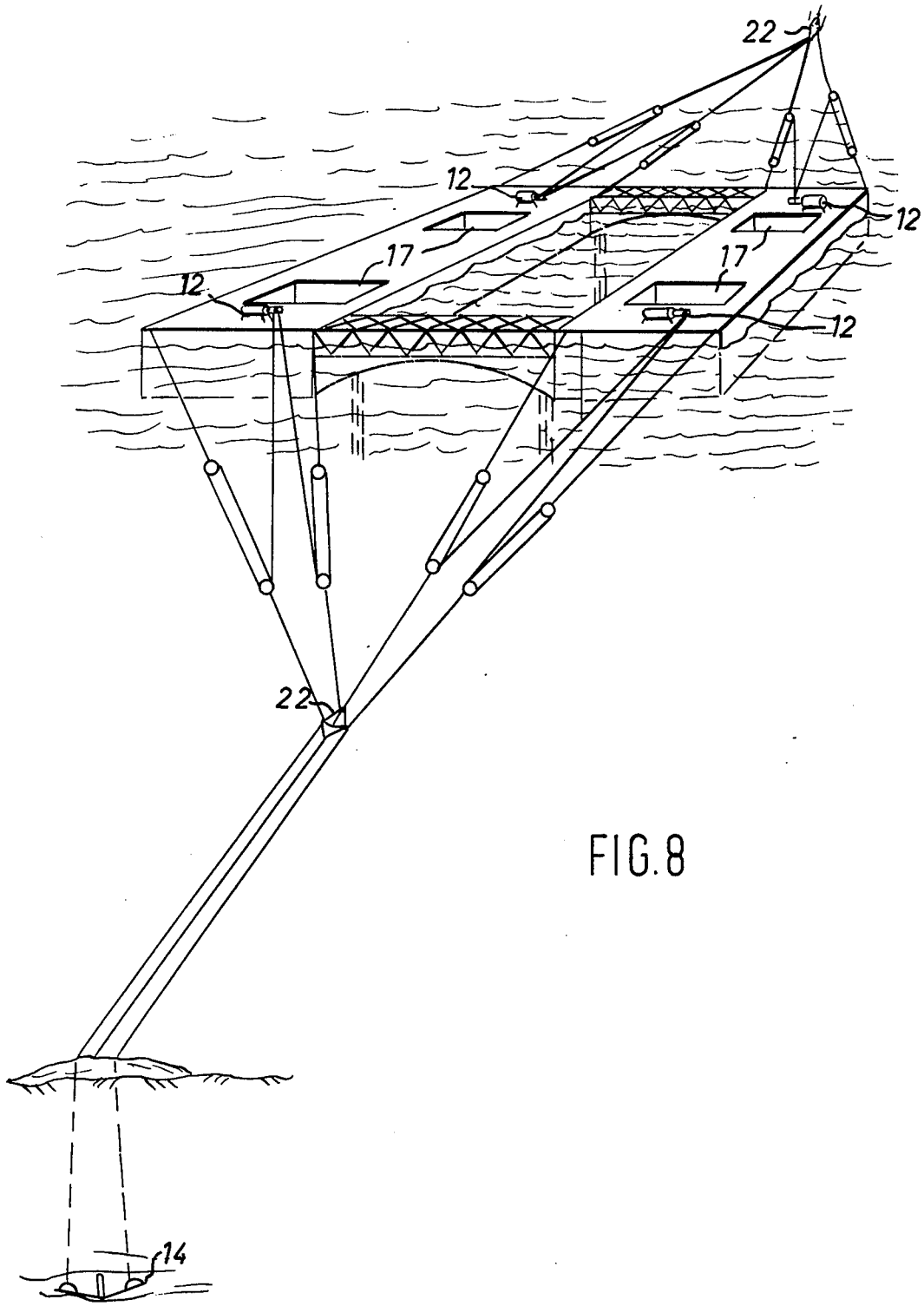
FIG. 8 shows one method of placing two more or less widely spaced pier legs together with a second pair to form a precise square or rectangle. The rectangle itself is also precisely located.

FIG. 8 is a partially perspective, partially elevational drawing to explain how a mated pair of pier heads 18 can become seized to heavy duty anchors by a system of winches and cables to any preferred alignment in regard to a preferred level bottom profile. The largest flat bottom surfaces are given priority preference in design of large gate structures to cover as much area with one flood gate as is desirable. The square openings 17 give access for insertion of pier legs.

The Extra heavy duty anchor and the octahedron 22 are not a part of this application.

I claim:

1. A water stream barrier structure comprising a pair of horizontally spaced sidewalls, a floor structure interconnecting the side walls, horizontally aligned water gate panel means pivotally mounted at its lower ends between the side walls and the upper side of the floor structure, stop means on the upstream side of the side walls for holding the water gate means in an upright closed position, whereby the gate panel means is in a closed position when the water level on the downstream side is above the water level on the upstream side and the gate panel means will open when the upstream water level is above the downstream water level.

2. The structure of claim 1 being supported by a culvert means extending under the floor of the structure and a closure means pivotally connected to the culvert upper edge and adjacent to the floor structure for pivoting about a horizontal axis and stop means at the lower edge of the culvert means for holding said closure means in a closed position on the upstream flow and in an open position on the downstream flow.

3. The structure of claim 1 further comprising buoyancy means on the downstream side of the gate means for self closing of the said gate means by the proper water level on the said downstream side.

* * * * *